United States Patent [19]

Eberline

[11] Patent Number: 4,784,096

[45] Date of Patent: Nov. 15, 1988

[54] CARBURETOR IDLE VENT CONTROL

[75] Inventor: William C. Eberline, Cass City, Mich.

[73] Assignee: Walbro Corporation, Cass City, Mich.

[21] Appl. No.: 595,716

[22] Filed: Apr. 2, 1984

[51] Int. Cl.[4] ..... F02M 1/16

[52] U.S. Cl. ..... 123/179 G; 123/180 E

[58] Field of Search ..... 123/179 G, 438, 179 B, 123/180 E, 180 R, 187.5 R; 261/39 D

[56] References Cited

U.S. PATENT DOCUMENTS

| | | | |
|---|---|---|---|
| 3,374,777 | 3/1968 | Walker | 123/179 B |
| 3,587,553 | 6/1971 | Sutton | 123/179 G |
| 3,741,188 | 6/1973 | Rickey | 123/179 G |
| 3,861,366 | 1/1975 | Masaki et al. | 123/438 |
| 3,872,851 | 3/1975 | Matsumoto et al. | 123/180 R |
| 4,466,412 | 8/1984 | McChesney et al. | 123/187.5 R |

*Primary Examiner*—Andrew M. Dolinar

*Attorney, Agent, or Firm*—Barnes, Kisselle, Raisch, Choate, Whittemore & Hulbert

[57] ABSTRACT

A carburetor for an internal combustion engine which includes a supplemental fuel chamber and fuel injector valve, manually or remotely actuated, to inject a charge of fuel into the fuel induction chamber of an associated engine and provide a continuing fuel supply to the engine, over and above, the normal carburetor system, to allow the engine to reach a warm-up stage and prevent stalling out until such stage is reached where normal carburetion can take over. Automatic refill and vent valves permit fuel recharge of the supplemental fuel chamber to insure readiness of the chamber for starting at all times. An idle vent is arranged to be closed electrically or otherwise to facilitate the starting cycle.

1 Claim, 6 Drawing Sheets

CARBURETOR IDLE VENT CONTROL

FIELD OF INVENTION

Carburetion for small engines and more particularly a starting system to facilitate quick start.

BACKGROUND OF INVENTION

In a copending U.S. application, Ser. No. 456,422, filed Jan. 7, 1983, now U.S. Pat. No. 4,509,471 having a common assignee to the present application, there is a disclosed a Start System for Internal Combustion Engines. In the system disclosed in that application, there is an idle flow system with a vent. It has been discovered that the start system will be enhanced and more efficient if means is devised to close the idle vent during the starting phase.

It is, therefore, an object of the present invention to provide an idle system in a carburetor which has a vent and means to close the vent at the will of an operator to render the starting system more efficient and reliable.

Other objects and features of the invention will be apparent in the following description and claims in which the invention is disclosed together with details to enable a person skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

Detailed Description of the Invention and the Manner and Process of Using It

Figure 1:
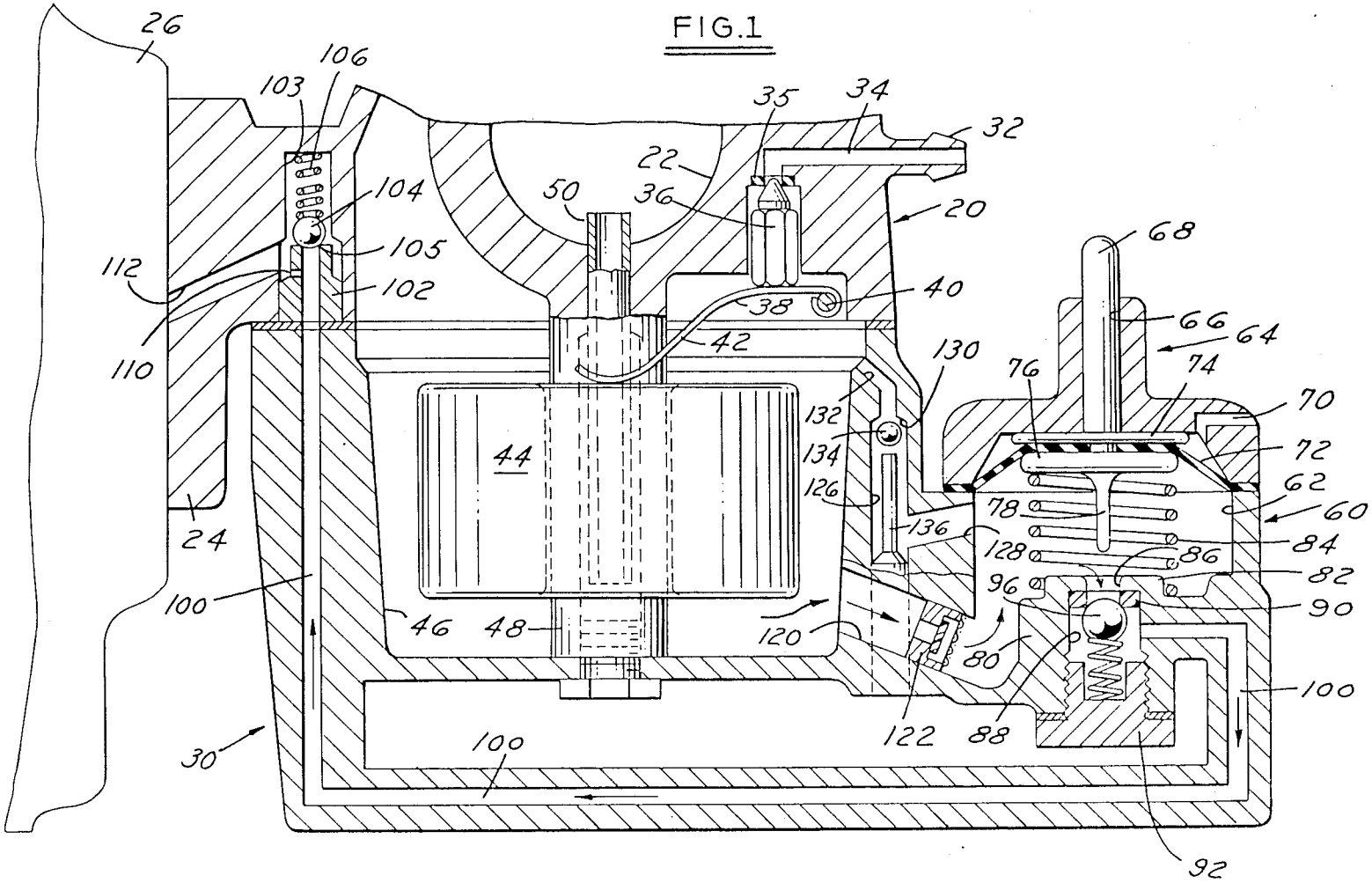
FIG. 1, a diagrammatic view of the system in connection with a float carburetor.

With reference to the drawing, in FIG. 1, a carburetor body 20 has a mixing passage 22 and a mounting flange 24 secured to an engine housing 26 at the fuel induction chamber. The presentation in FIG. 1 is partially diagrammatic to enable the concept to be presented in a single plane. The remaining FIGS. 2 to 10 show how the concept can be adapted to a commercial carburetor.

Below the carburetor body 20 is a float chamber housing 30 which would be secured and sealed to the body 20 in a suitable manner. Body 20 has a fuel inlet nipple 32 connected to a passage 34 terminating at a valve seat 35. This nipple 32 will be connected to a suitable fuel supply reservoir. An inlet valve 36 rides on a lever 38 pivoted at 40. The curved distal end 42 of lever 38 rides on the top of a fuel float 44 which is suitably mounted in the fuel chamber 46 of the housing 30. The float 44 is guided on a central column 48 which carries a main nozzle tube 50 in communication with the fuel chamber and open to the venturi portion of the mixing passage 22. The required throttle valve of standard construction is not shown in this FIG. 1.

Integral with body 30 is a body 60 having a fuel injection chamber 62. A plunger cap 64 is suitably secured to the body 60. The cap has a central bore 66 to receive a plunger shaft 68. The interior of the cap is vented to atmosphere by a port 70. An expulsion diaphragm 72 is secured at its periphery between registering flanges of the body 60 and the cap 64.

The central area of the diaphragm 72 is clamped between a disc 74 and a disc 76 secured to the bottom end of plunger 68, which has an actuator pin 78 depending therefrom. The disc 76 has an interference fit with the base of pin 78 and is sonic welded to the pin. These parts can be made from a suitable plastic having good resistance to hydrocarbons.

In the base of the body 60 is a central riser 80 having a reduced portion 82 to serve as a seat for a coil compression spring 84 which seats at the other end on disc 76 to urge the plunger 68 and diaphragm 72 to an "up" position. An opening 86 and a bore 88 provide a seat location for a valve seat 90. A threaded screw plug provides a spring closure 92 serving as a seat for the lower end of a coil spring 94 which bears at the other end against a valve check ball 96 serving as a main injector valve. The projection of the shaft 68 out of the cap 64 must be dimensioned such that when the plunger is depressed, the pin 68 will move the ball 96 off the seat 90.

The bore 88 has a port between the ball 96 and the threaded closure plug 92 which leads to a passage 100 in housings 30 and 60 terminating at plug 102 in the lower end of a stepped bore 103 in housing 20. The plug 102 has a central bore connected to passage 100 at the top of which is a discharge valve seat 105 against which a ball valve 104 is pressed by a coil spring 106 seated at the top of the bore 103.

The plug 102, which has the valve seat 105 at the end thereof, also has a calibrated side passage 110. A fuel port 112 in body 20 and flange 24, leading to the engine fuel supply manifold (induction chamber), connects to the bore 103 and, through passage 110, is also in communication with the passage 100.

Returning for the moment to the injection chamber 62, a fuel passage 120 leads from the bottom of the float chamber 46 to the bottom of the injection chamber through a one-way valve insert 122 which admits fuel into chamber 62. A second vertical passage 126 has a side branch 128 open to chamber 62 and a top valve seat 130 open to a passage 132 communicating with the top of the float chamber 46. A check valve ball 134, which is preferably formed of a material such as nylon, is held in a valve relationship adjacent to seat 130 by a pin 136 pressed into the bottom of bore 126.

OPERATION of the FIG. 1 Disclosure

Assuming that the float chamber is charged with fuel, the check valve 122 will allow fuel to flow into the fuel injection chamber 62. The vent valve 134 will provide air release as the chamber 62 fills.

When the assembly is being used in the starting of a cold engine, the plunger 68 is depressed to actuate the expulsion diaphragm and increase pressure in chamber 62. Initially, this pressure, exerted through the movement of the diaphragm, will close the inlet valve 122 and the vent valve 134. As the plunger is further depressed against the body of fuel in chamber 62 and against the resilience of the spring 84, the actuator pin 78 will contact the resiliently biased main injector valve 96 and dislodge it from the seat 90. Fuel will then be forced through the piston action of the expulsion diaphragm to the passage 100 and the ball valve 104 will move off from its seat against the spring 106 to allow a reasonably large charge of fuel to reach the passage 112 leading to the fuel manifold of an engine.

A starting movement of the engine, whether by a manual pull or an electric starter, will draw this charge of fuel into the engine and, assuming normal spark action, will cause the engine to start. Once the fuel is expelled from the chamber 62 by the depression of the plunger assembly 68, and the passage of the fuel charge through valve 104, the pressure in passage 100 will diminish and valve 104 will close. However, a continued depression of the plunger 68 will keep the main injector valve 96 open and fuel can continue to flow to the engine from chamber 62 and passage 100 through the calibrated side port 110. Thus, a continued supply of extra fuel, over and above that for which the engine and the carburetor are calibrated, will flow through the carburetor and will reach the engine during a warm-up period to prevent stalling. After a warm-up period, the plunger can be released and the engine will run on the normal fuel supply for which the carburetor is calibrated.

Upon release of the plunger 68, the spring 84 will move the diaphragm 72 up and the chamber 62 will refill through the valve 122. At the same time the main injector valve 96 will close to prevent fuel from being sucked out of the fuel injection chamber 62 during the normal engine operation.

With the described system, the chamber will always have fuel when the float chamber is full and there is no need to prime this chamber in the starting operation. Thus, "one-pull" starting can usually be achieved.

The EMBODIMENT of FIGS. 2 to 8

Figure 2:
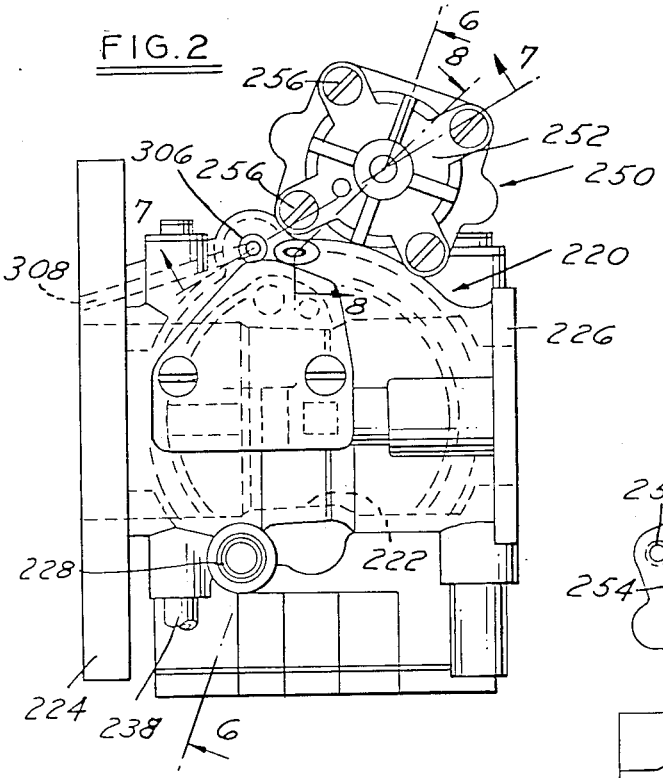
FIG. 2, a top view of a carburetor incorporating the starting system.

In FIGS. 2 to 8, a float carburetor is illustrared incorporating the invention. A top view of the assembly in FIG. 2 shows a body 220 having a venturi passage 222 (dotted lines) and an engine mounting flange 224. An air inlet mounting flange 226 is provided at the other end of the carburetor. A fuel inlet connection 228 leads to an inlet valve as shown in FIG. 1 controlled by the position of the float 230 in a float chamber 232. A throttle shaft control 238 operates a throttle valve 240. Generally speaking, no choke valve is needed with the fuel injection system described herein.

Integral with the float bowl housing, which is secured by a nut 242, is a fuel injector assembly 250 having a top housing 252 and a bottom housing 254 secured by screws 256 (FIGS. 2, 3, 4 and 8). A fuel pump 258 of standard construction, actuated by engine pulses, is appended to the housing 220 to provide fuel to the float chamber.

Figure 5:
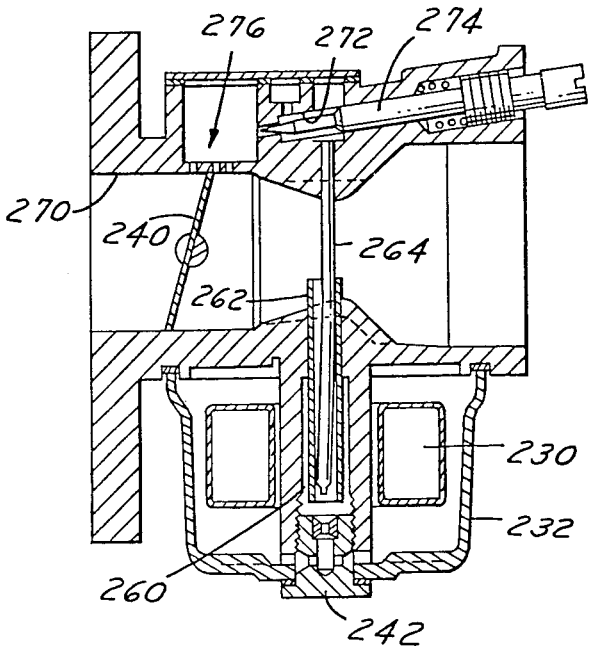
FIG. 5, a central sectional view of a carburetor showing the float and idle control.

In FIG. 5, fuel from the float chamber enters a center well 260 through side and center passages in the screw 242 and becomes available to the lower end of concentric tubes, namely, an outer main fuel nozzle tube 262 and an inner idle tube 264. The outer nozzle tube opens to the venturi of an air mixing passage 270. The inner tube opens to a chamber 272, the outlet of which is controlled by an adjustable idle needle valve 274 which admits the idle fuel supply to idle ports 276 opening to the mixing passage 270.

Figure 6:
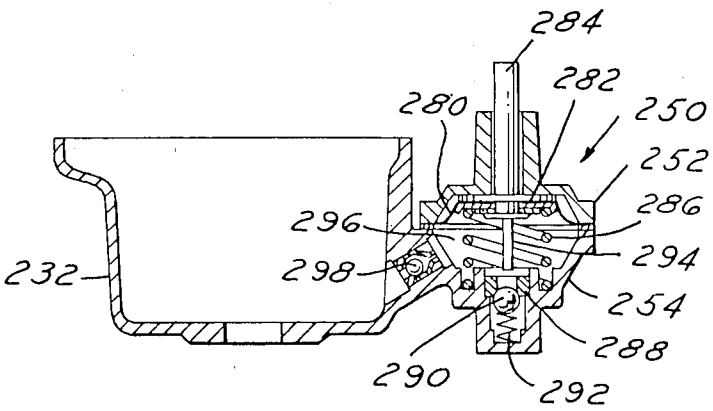
FIG. 6, a sectional view of the injection system and float chamber taken on line 6—6 of FIG. 2.
Figure 7:
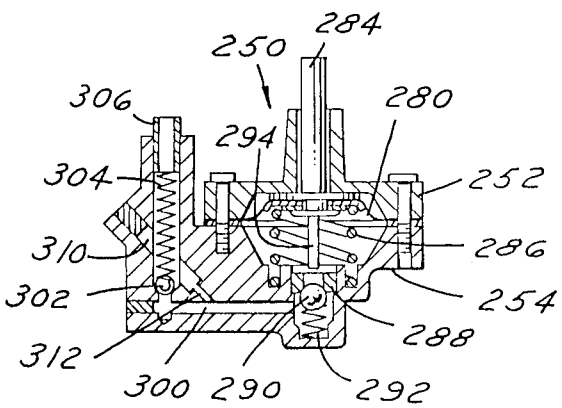
FIG. 7, a sectional view of the injection system taken on line 7—7 of FIG. 2.

In FIGS. 6 and 7, two sectional views of the fuel injector assembly are shown. In FIG. 6, a section on line 6—6 of FIG. 2, it will be seen that the housings 252 and 254 clamp the periphery of a diaphragm 280 in a sealing arrangement. The center of the diaphragm is clamped between a disc enlargement on the bottom of a plunger shaft 284 and a disc 282, and a spring 286 urges the plunger to an up position. In the base of the housing 254 is a valve seat 288, closed normally by a main injector valve 290 biased to a closed position by a spring 292. A downwardly projecting stem 294 on plunger shaft 284 is provided to move valve 290 away from seat 288. A chamber 296 below the diaphragm is open to the float bowl chamber 232 through an unbiased check valve 29 which allows fuel to flow from the float chamber to chamber 296.

In FIG. 7, it will be seen that the small chamber below valve 290 is open through a passage 300 to a spring biased check valve 302 leading to a bore 304 which opens to a passage 306 connected to a cross passage 308 (FIG. 2, dotted lines) leading to the engine flange 224 and the fuel induction passage of the engine on which the carburetor is mounted. Referring back to FIG. 7, an angled passage 310 has a calibrated portion 312 which by-passes the check valve 302.

Figure 11:
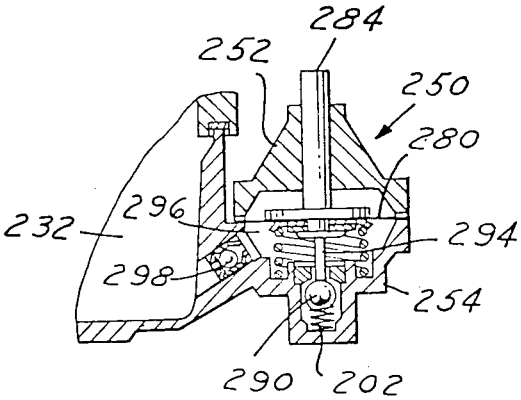
FIG. 11, a sectional view similar to FIG. 6 with the actuator depressed.

When the plunger 284 is depressed, the projecting end 294 of the plunger will contact and move the main injector valve 290 to open this valve 290. This will force fuel through the passage 300 and past valve 302 to the fuel induction chamber of the engine to provide a starting charge. As long as the plunger is depressed, fuel can move through the calibrated passage 312 after the valve 302 closes and additional fuel will be available to the engine during a warm-up period. In FIG. 11, the plunger 284 is shown depressed and the valve 290 open.

Figure 8:
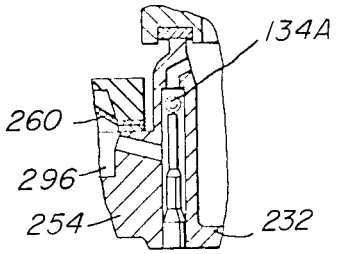
FIG. 8, a sectional view on line 8—8 of FIG. 2.
Figure 3:
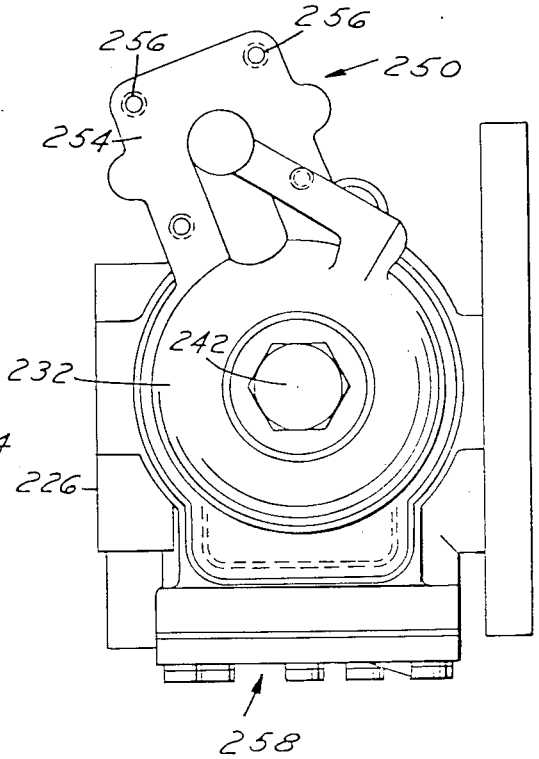
FIG. 3, a bottom view of the carburetor shown in FIG. 2.
Figure 4:
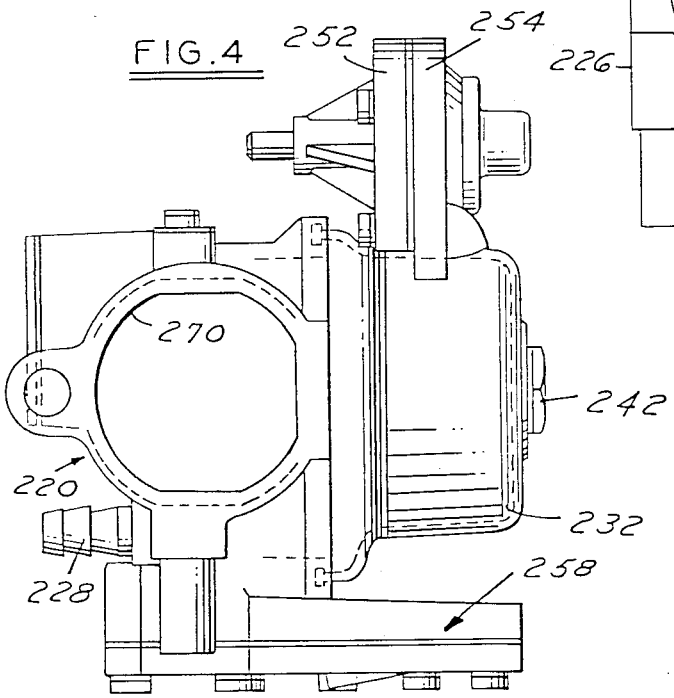
FIG. 4, an end view of the carburetor illustrated in FIGS. 2 and 3.

A vent valve 134A shown in the sectional view of FIG. 8, like valve 134 in FIG. 1, is provided to allow the diaphragm chamber 296 to fill through the check valve 298. When the diaphragm 280 is depressed, both the vent valve 134A and the inlet check valve 298 will close.

Figure 10:
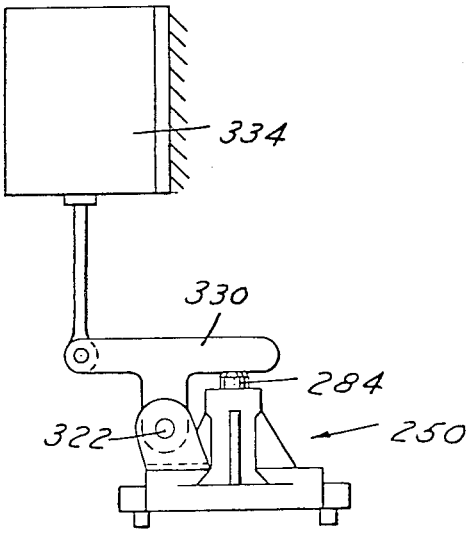
FIG. 10, a view of a solenoid operated actuator.
Figure 9:
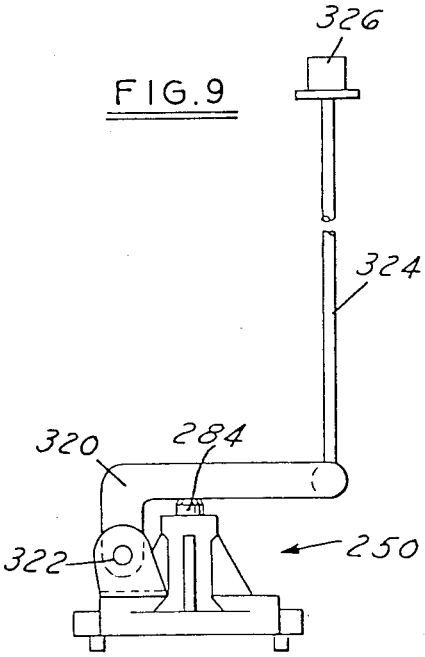
FIG. 9, a view of a remote mechanical actuator.

In FIGS. 9 and 10, alternate operating mechanisms are shown. In FIG. 9, a mechanical linkage is illustrated. An L-shaped lever 320 pivoted at 322 is actuated by a shaft 324 with a remote plunger 326. In FIG. 10, a T-lever 330 pivoted at 332 has one end overlying plunger 284. A solenoid 334 actuates the other end of lever 330 to depress the plunger on a signal from an operator.

When the plunger is depressed, it is desirable that a linking mechanism (not shown) open the throttle slightly to a calibrated position in relation to the size of the passage 312. In FIG. 11, the sectional view similar to the view in FIG. 6, illustrates the plunger 284 in the depressed position with the valve 290 open.

Thus, it will be seen that the integral fuel injection system permits fast starts in cold engines and provides additional supplemental fuel at idle speeds to keep the engine running as it warms up to the degree that normal carburetion may be relied upon. Furthermore, the starting system is always ready for operation since the fuel in the chamber automatically replenishes and cannot be purged from the injection chamber by the high vacuum in the mixing passage of the carburetor during normal operation.

Figure 12:
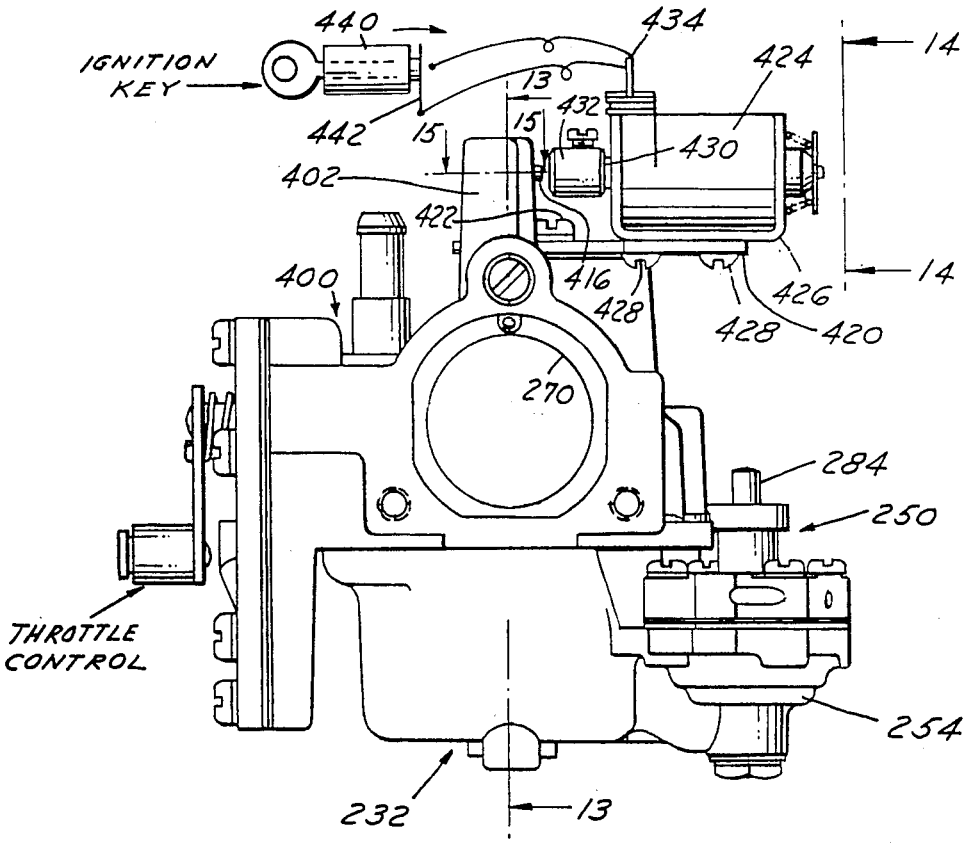
FIG. 12, a view of the carburetor showing the idle vent control.
Figure 13:
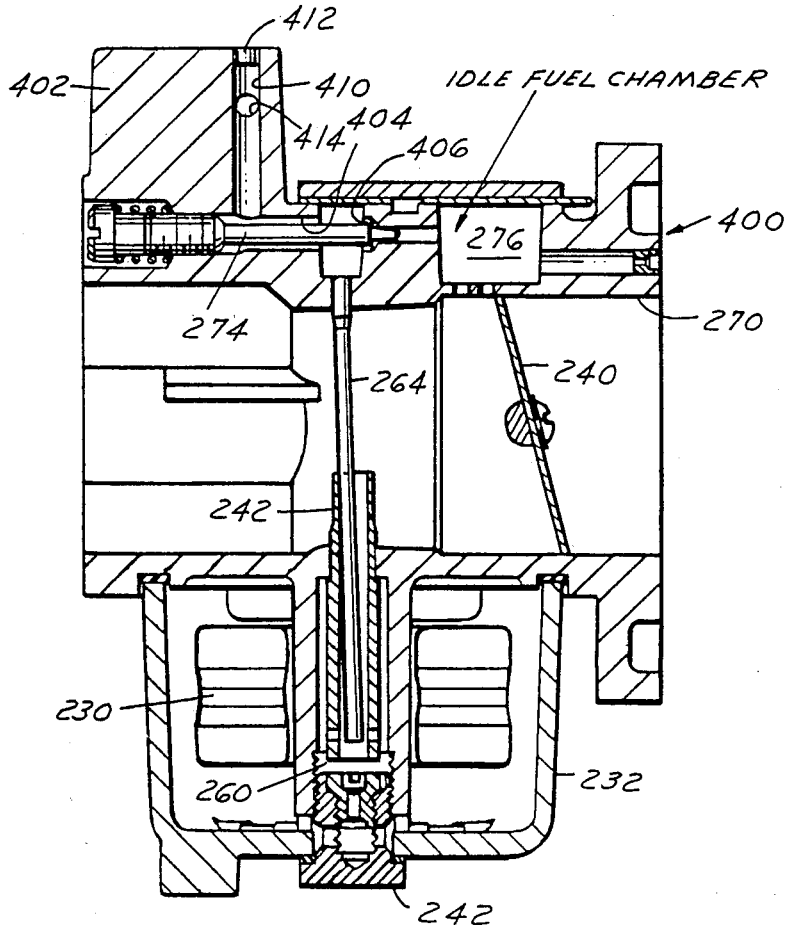
FIG. 13, a section line line 13—13 of FIG. 12.

Another feature of the invention is illustrated in FIGS. 12 to 15. The carburetor body 400 shown in FIG. 12, viewing the mixing passage from one end, is shown in section in FIG. 13, a section on line 13—13 of FIG. 12. The sectional view in FIG. 13 is similar to that described above in connection with FIG. 5 but from the opposite side. Similar parts have the same reference characters.

Figure 15:
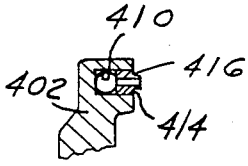
FIG. 15, a small section on line 15—15 of FIG. 12.

A dome 402 is formed on the carburetor body, rising above the idle control valve 274, which projects through the bore 404 into the idle control valve seat 406. In the dome 402 rising from the bore 404 is a passage 410 plugged at the top at 412. An idle air vent port 414 opens the passage 410 to atmosphere. As shown in FIG. 15, the atmospheric air vent is closed by a small valve nipple 416 which has a central passage and a reduced projection beyond the surface of the dome 402.

Figure 14:
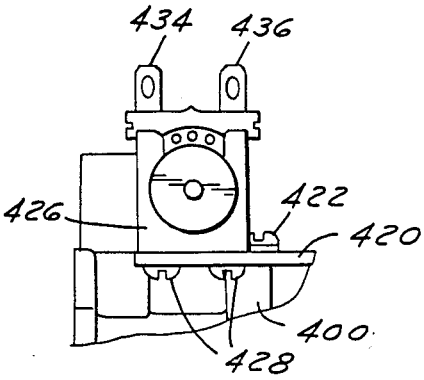
FIG. 14, a view of the idle vent control taken on line 14—14 of FIG. 12.

With reference to FIGS. 12 and 14, a bracket 420 is secured to the carburetor housing 400 by screws 422. Supported on this bracket is a solenoid housing 424 supported in a U-shaped retainer 426 secured by screws 428.

The solenoid has an armature 430, a portion of which projects outwardly to mount a small plug 432 adjustable on the armature. The plug 432 has an outer surface to cooperate with and close the vent nipple 416 when the solenoid is energized. The solenoid has connectors 434, 436 which are shown diagrammatically connected to an ignition switch cylinder 440. When the ignition cylinder is pushed in, a switch 442 will connect the solenoid to a power source (battery) and the solenoid will be energized. This projects plug 432 outward to close the idle fuel vent nipple 416. With the idle vent closed, there will be a greater vacuum pull on the idle vents and the air-fuel mixture will be richer for the start of the engine. If the engine slows after the idle vent is opened, the key cylinder may again be pushed in to close switch 442 to close the vent until the engine reaches the desired revolutions.

With a land vehicle, a suitable filter can be placed in the air vent. On water craft, this would not be essential.

I claim:

1. In a carburetor for providing fuel to engines, such a outboard motors and land vehicles, the carburetor being of the type having a housing and a fuel and air mixing passage in said housing connected to the fuel induction chamber of an internal combustion engine, a main fuel nozzle and idle passages connected to said mixing passage, that improvement which comprises:

(a) an idle fuel chamber associated with said idle fuel passages, (b) means forming an atmospheric passage in communication with said idle fuel chamber, (c) means responsive to operator control to close said atmospheric passage to increase flow to said mixing passage to create a rich mixture to assist in engine starting, (d) said atmospheric passage terminating externally of said carburetor housing in a projecting nipple having an external end with a bore opening to atmosphere to provide an atmospheric passage, (e) said means to close said atmospheric passage comprising a plug movable against said nipple to close said bore, (f) said means responsive to operator control comprising an electric solenoid having an armature portion provided with a flat surface to move toward said external end of said atmospheric passage in said nipple to close said passage in response to eneregization of said solenoid, and (g) an operator controlled switch provided for remote control of said solenoid, said switch being associated with an ignition key cylinder and operated by longitudinal shifting of said cylinder.

* * * * *